United States Patent [19]

Grout et al.

[11] 4,373,285

[45] Feb. 15, 1983

[54] GUN MUZZLE LOADER

[76] Inventors: Kenneth M. Grout, P.O. Box 190, Littleton, N.H. 03561; David W. Presby, Hadley Rd., Sugar Hill, N.H. 03585

[21] Appl. No.: 191,397

[22] Filed: Sep. 29, 1980

[51] Int. Cl.[3] ..... F41C 27/00

[52] U.S. Cl. ..... 42/90

[58] Field of Search ..... 42/90

[56] References Cited

U.S. PATENT DOCUMENTS

| | | | |
|---|---|---|---|
| 243,250 | 6/1881 | Hall | 42/90 |
| 3,747,252 | 7/1973 | Walker | 42/90 |
| 4,050,175 | 9/1977 | Mulinix | 42/90 |
| 4,112,606 | 9/1978 | Griffin | 42/90 |
| 4,123,868 | 11/1978 | Wilson | 42/90 |
| 4,152,858 | 5/1979 | Dobbs | 42/90 |

*Primary Examiner*—Charles T. Jordan

*Attorney, Agent, or Firm*—Elmer J. Gorn; David A. Tucker

[57] ABSTRACT

A loading device and method for loading a muzzle loading gun. The device comprises an elongated attachment with a longitudinal bore across which is placed a frangible septum. The bore above the system is loaded with a premeasured powder charge and a projectile with wadding (if necessary). The attachment is placed on the end of the muzzle of the gun, the septum is sundered by sundering means within the attachment, the powder passes by the sundered septum and the projectile is rammed into position by a ram rod inserted through the upper open end of the bore of said attachment.

4 Claims, 2 Drawing Figures

GUN MUZZLE LOADER

BACKGROUND OF THE INVENTION

In the sport of precision shooting with a muzzle loading gun, the accuracy with which the marksman can predict the trajectory of the projectile fired from his gun depends upon a number of subtle skills. One of the most important of these is the ability of the marksman to predetermine the exact quantity of gunpowder with which to load his gun to produce the desired trajectory. His ability to do so depends upon his familiarity with the characteristics of his gun and of the projectile he is using. Since the actual loading of the powder charge and projectile into the gun muzzle must take place in the firing field, the tensions encountered make it virtually impossible to achieve optimum loading using prior art devices and methods. One can never be sure, even with a packet containing a premeasured quantity of powder, that none of the powder will be lost in pouring the powder into the gun muzzle or that none of the powder will remain in the packet. Therefore it is highly desirable for a simple, effective device and method be devised to enable the marksman to accomplish the desired accuracy of loading with certainty and assurance.

SUMMARY OF THE INVENTION

The invention comprises a loading assembly which can be accurately preloaded with powder and projectile and a method of transferring the preloaded charge into the muzzle of the gun on the firing field in a simple procedure which assures the marksman that the final charge is exactly as he had preplanned.

The loading assembly is provided with a bore extending throughout its length and with a frangible septum disposed across the bore at a substantial distance below the upper end, thereby providing a pocket into which the premeasured powder charge and the projectile may be loaded. The assembly is adapted to be placed on the end of the gun muzzle and means are provided to sunder the septum so that the powder and projectile may be freed to be rammed into the muzzle by a ramrod inserted through the upper end of the assembly bore. The assembly itself is comprised of an upper and a lower member which may be assembled with and detached from each other transverse to the assembly bore at the location of the septum. The septum is adapted to be held in position between the two assembled members. That portion of the assembly bore in which the powder and projectile are loaded is provided by a hollow sleeve slidably mounted within the upper member of the assembly and elastic means are provided to hold the sleeve in position with its lower edge in contact with the septum. When it is desired to transfer the preloaded charge into the gun muzzle, the assembly is placed on the end of the muzzle and the sleeve is forced, from its retention by the elastic means, down through the septum whereby the lower edge of the sleeve sunders the septum. Thereby such lower edge constitutes the sundering means mentioned above. The sundering is so designed as to occlude the septum material from entering the gun.

BRIEF DESCRIPTION OF THE DRAWINGS

The drawing illustrates a preferred embodiment of the invention in which.

DESCRIPTION OF THE PREFERRED EMBODIMENT

Figure 1:
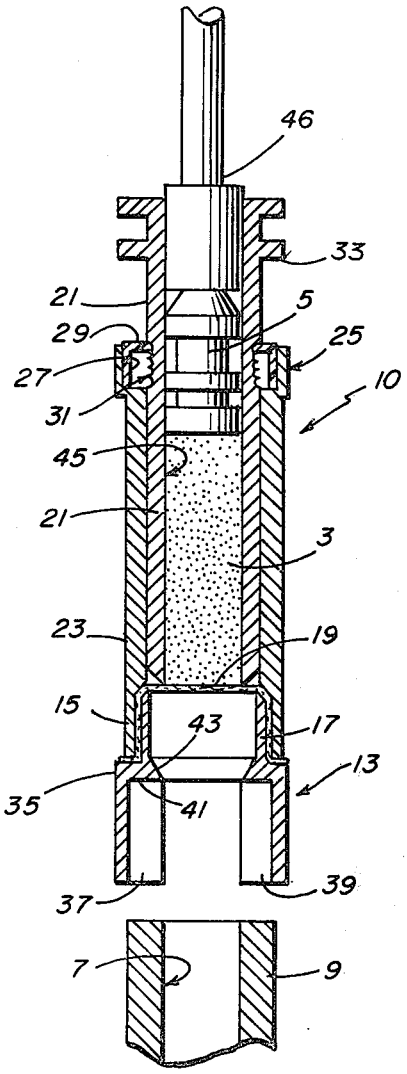
FIG. 1 is a longitudinal cross-section of the loading device shown in relationship to the parts of the gun barrel and ramrod with which it is designed to cooperate.
Figure 2:
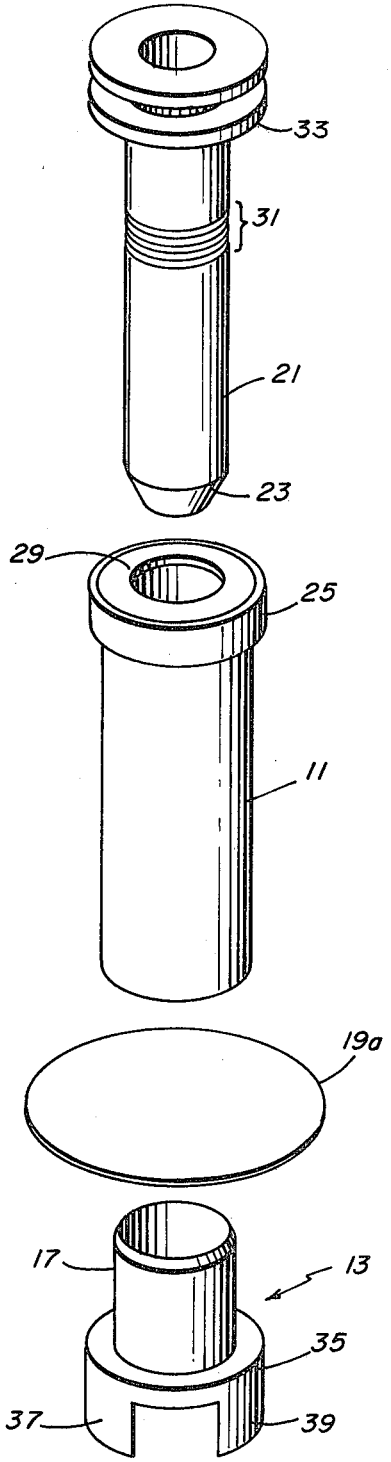
FIG. 2 is an exploded elevational view of the several parts of the loading device shown in FIG. 1.

As shown in FIG. 1, the assembly is designed to load a predetermined quantity of a powder charge 3 and a projectile 5 into the bore 7 of the muzzle 9 of a muzzle loading gun. The main body 10 of the assembly comprises an upper member 11 and a lower member 13 which are adapted to be assembled and disassembled by providing the upper member 11 with a depending sleeve 15 which fits over an upstanding sleeve 17 on the lower member 13. It will be noted that the main body has a vertical bore which extends throughout the length of said body. The continuity of free passage through such bore is interrupted by a septum 19 extending across the upstanding sleeve 17 of lower member 13. As may be seen more clearly in FIG. 2, such septum is provided in the form of a paper disc 19*a* which is placed across the top of sleeve 17. Therefore when member 11 is forced on to member 13, the depending sleeve 15 (FIG. 1) folds the outer portions of paper disc 19*a* down around the sides of sleeve 17 and securely holds the septum 19 in place. The clearance between the sleeves 15 and 17 is so small that the folded parts of paper disc 19*a*, interposed between said sleeves, forms a tight squeeze fit to retain members 11 and 13 in their assembled relation. Preferably the material of disc 19*a* is moisture proof waxed paper.

The loading device is also supplied with an elongated sleeve 21 which is inserted into the upper end of member 11 and provides a sliding fit with the inner wall of the bore of member 11. The lower margin of sleeve 21 is tapered at 23 which provides a relatively narrow lower edge to sleeve 21 which, when forced past the septum 19, will break or tear the septum along at least a major portion of its perimeter and thus sunder it to open up a relatively free passage through the vertical bore of the assembly. Normally, however, the sleeve 21 is firmly held in position with its lower edge resting on top of the septum 19. For this purpose, the upper end of member 11 terminates in a ring 25 providing a ring shaped pocket into which is forced a cup shaped retaining element 27 formed of a material, such as a plastic, having a sufficient degree of elasticity to cause its ring-shaped upper portion 29 to snap into one of several of a plurality of circular grooves 31 (FIG. 2) in the outer wall of sleeve 21 to hold said sleeve firmly against any further accidential movement. The snapping of ring 29 into the first groove will slow the motion of sleeve 21 thus insuring that ring 29 will snap into a groove that will firmly hold sleeve 21 in place once positioned firmly against the septum 19. The material of septum 19 is sufficiently strong and elastic so that a moderate amount of pressure by the lower edge of sleeve 21 against septum 19 will not sunder the septum but will produce a desired degree of sealing contact between the lower edge of sleeve 21 and septum 29. The material of septum 19 also being waterproof keeps the powder dry.

Once the upper and lower members 11 and 13 have been assembled with septum 19 in place and sleeve 21 has been inserted and retained in place by ring 29, the assembly is ready to be loaded with the powder charge 3 and projectile 5. Such loading can occur away from the tension of the firing field where the marksman can carefully measure the exact amount of powder which in the marksman's skilled judgement will produce the desired trajectory of the projectile 5, taking into consideration the characteristics of the particular gun which the marksman will be using. One method of loading such premeasured amount of powder will be to pour the powder into the upper open end of sleeve 21 where it will drop down onto and be retained by the septum 19. Thereupon the projectile 5 will be inserted into the sleeve 21 above the powder charge 3. In the embodiment shown, the projectile 5 forms a press fit with the bore of sleeve 21 and thus holds the projectile 5 and powder 3 in place while sealing the bore against escape of the powder through the upper end of sleeve 21. The marksman will prepare and load as many of such assemblies as he may wish to use in any shooting session.

In addition to the structure described above, the lower member 13 is formed with a bifurcated lower extension 35 providing a pair of curved arms 37 and 39. The arms 37 and 39 are sufficiently elastic so that they will adapt themselves to a wide range of sizes of gun barrels and will firmly grip the sides of such barrels to hold the loading structure in place during the loading operation. The member 13 is also formed with a stop shoulder 41 at the upper ends of the arms 37 and 39. Therefore, when the marksman is ready to load his rifle, he places the assembly 10 on the end of the muzzle 9 until the muzzle seats firmly against shoulder 41 with the arms 37 and 39 firmly fitting the sides of the muzzle. The assembly 10 is thus held in the desired alignment with the muzzle bore 7. Thereupon the marksman strikes the upper end of sleeve 21 a sharp blow with his hand which releases the sleeve 21 from the hold of retaining ring 29 and drives the sleeve 21 down until a shoulder 33 at the upper end of sleeve 21 contacts the upper end of the ring 25 and its retaining element 27 structure. This will stop the motion of the sleeve 21 so that its tapered end 23 does not strike the upper beveled shoulder 43 within the member 13. In this way any accidental striking of powder 3 will be prevented.

The foregoing procedure will cause the tapered end 23 to sunder the septum 19 and move it out of the path of the powder 3. The tapered end 23 does not cut a clean circular section out of the septum 19, but rather it will tear the septum into segments which will be folded back against the inner wall of sleeve 17. Since the surface of bevel 23 faces the inner wall of sleeve, the bevel itself assists in such folding so as to occlude the septum material from entering the gun muzzle and fouling the charge. It will also be noted that the size of the bore 45 equals the size of bore 7 of muzzle 9 so that a substantially unobstructed smooth path is provided for powder 3 to all into bore 7.

The marksman then inserts a ramrod 46 into the upper end of sleeve 21 and rams the projectile 5 together with any residual powder into firing position within bore 7 of muzzle 9. Assembly 10 is then lifted from muzzle 9 and set aside to be reloaded by the marksman at his leisure.

It is to be understood that the preferred embodiment, as detailed above, constitutes but one embodiment of the invention and that other modifications may be made. For example, the members of assembly shown as being of metal could be molded from synthetic plastic. The septum 19 could be made of any material which could be sundered to destroy its continuity by any desired means operable by the marksman. Wadding could be added to the material to be rammed into the gun barrel. Other modifications, within the scope of the appended claims, will suggest themselves to those skilled in the art.

We claim:

1. A loading device for a muzzle loading gun comprising:

(a) an attachment assembly provided with an elongated bore extending from the lower to the upper end of said assembly, the lower end of said assembly being adapted to be placed on the end of a gun barrel with said bore substantially in alignment with the bore of said gun barrel;

(b) a frangible septum held across the bore of said assembly substantially below its upper end, said bore above said septum being adapted to receive a powder charge and a projectile;

(c) said assembly including an elongated sleeve slidably mounted in said assembly above said septum, the bore of said sleeve comprising that portion of said assembly adapted to receive said charge and projectile;

(d) the lower edge of said sleeve being adapted to sunder said septum when forced through the location of said septum whereby said lower edge comprises means for sundering said septum.

2. A loading device as in claim 1 in which said sleeve is normally held with its lower edge above its sundering position by means of an elastic ring fixed in said upper member and engaging a corresponding groove in the outer wall of said sleeve, the combination of said ring and groove being adapted to release said sleeve from said ring only under a relatively large force exerted upon said sleeve.

3. A loading device as in claim 1 in which the lower end of said assembly is provided with a plurality of elastic arms adapted to grip the sides of said barrel, the elasticity of said arms being sufficient to adapt said assembly to a range of sizes of gun barrels.

4. A loading device as in claim 1 in which the lower edge of said sleeve is tapered in a direction away from the adjacent sides of said assembly whereby said lower edge also provides means for moving the sundered septum out of the path of motion of said charge and projectile onto the bore of said gun barrel, whereby the sundered septum is occluded from passing into said gun barrel.

* * * * *